US009861217B1

(12) United States Patent
Ingels

(10) Patent No.: US 9,861,217 B1
(45) Date of Patent: Jan. 9, 2018

(54) ART CLAMP

(71) Applicant: Luis Ingels, Duarte, CA (US)

(72) Inventor: Luis Ingels, Duarte, CA (US)

(73) Assignee: Luis and Martha Ingels Trust, Duarte, CA (US)

( * ) Notice: Subject to any disclaimer, the term of this patent is extended or adjusted under 35 U.S.C. 154(b) by 0 days.

(21) Appl. No.: 15/680,125

(22) Filed: Aug. 17, 2017

Related U.S. Application Data

(60) Provisional application No. 62/441,310, filed on Dec. 31, 2016.

(51) Int. Cl.
*A47F 7/14* (2006.01)
*A47G 1/18* (2006.01)
*B65D 81/02* (2006.01)

(52) U.S. Cl.
CPC ..... *A47G 1/18* (2013.01); *B65D 81/02* (2013.01)

(58) Field of Classification Search
CPC . A47G 1/18; A47G 1/21; A47G 1/215; A47G 1/16; A47G 1/1606; B65D 81/02; B43L 5/02; B43L 12/00; A47B 23/06
USPC ..... 248/488, 447.1, 447.2, 451–453; 40/658, 40/647; 24/327; 16/341
See application file for complete search history.

(56) References Cited

U.S. PATENT DOCUMENTS 423,789 A * 3/1890 Miller ..... A47B 23/042 248/451
864,254 A * 8/1907 Perkins ..... A47F 3/001 24/457
2,503,015 A * 4/1950 Weisheit ..... A47B 23/043 248/453
3,161,724 A * 12/1964 Greene, Jr. ..... H02G 7/12 174/146
3,586,292 A * 6/1971 Buck ..... H01R 43/00 174/146
3,991,967 A * 11/1976 Sack ..... A47B 23/043 248/448
5,020,233 A * 6/1991 Syken ..... B43L 7/12 33/418
5,052,650 A * 10/1991 Beile ..... A47B 19/10 248/451
5,232,360 A 8/1993 Ingels
5,440,789 A * 8/1995 Lofland ..... F16G 11/101 24/132 R
6,000,941 A 12/1999 Ingels
7,406,774 B2 * 8/2008 Shapiro ..... G01B 3/563 33/471
7,434,509 B2 * 10/2008 Winston ..... B41K 1/06 101/127.1
7,866,070 B2 * 1/2011 Beyer, Jr. ..... B42D 5/005 24/303

(Continued)

OTHER PUBLICATIONS

"Masterpak—Oz Clip, Oz Clips" advertisement from www.masterpak-usa.com website, Jul. 19, 2017.

(Continued)

*Primary Examiner* — Christopher Garft
(74) *Attorney, Agent, or Firm* — Loza & Loza, LLP; Michael Fredrick

(57) ABSTRACT

A clamp adapted to retain paintings which includes a female piece rotatably connected to a male piece. The proximal end of the female piece includes a sloped locking shoulder which engages a distally extending horizontal flange in the proximal end of the male piece in order to lock the clamp.

16 Claims, 8 Drawing Sheets

(56) References Cited

U.S. PATENT DOCUMENTS

| | | | | |
|---|---|---|---|---|
| 8,210,845 | B1 | 7/2012 | Ingels | |
| 2006/0175521 | A1* | 8/2006 | Weiss | B42F 3/003 248/452 |

OTHER PUBLICATIONS

"Oz Clips" advertisement from www.ashleydistributors.com website, Jul. 19, 2017.

* cited by examiner

ART CLAMP

CROSS-REFERENCE TO RELATED APPLICATIONS

This application claims the benefit of priority under 35 U.S.C. § 120 from U.S. Patent Application No. 62/541,310, filed Dec. 31, 2016. The disclosure of the foregoing application is incorporated herein by reference in its entirety.

BACKGROUND

When moving works of fine art, in particular paintings, from one location to another, they need to be protected from damage. To protect a painting during travel, it is typically placed in a crate or travel box. The painting is typically secured to the crate or travel box with clips or brackets attached to the back of the painting, such as with the brackets sold under the trade name OZCLIP. Such brackets comprise two rotatably connected rectangular pieces, which are held in an open position by a screw extending between respective ends of the rectangular pieces which holds the pieces in place through friction between adjacent surfaces of the rectangular pieces.

SUMMARY

There remains a need for more secure brackets or clamps which can be locked into position when it is desired to secure an object, and which do not rely on screws to secure the bracket. The present clamp or bracket can be reversibly locked into position without the use of a screw due to the unique design of engagement surfaces in the hinge portion of the device, in particular the sloping surface of a locking shoulder which contacts the lower surface of a flange in the hinge. The present device can be used in a number of settings, but is in particular adapted to be attached to a travel frame for paintings in order to move fine art, in particular paintings, from one place to another.

The present clamp comprises an elongated female piece rotatably connected to a post on an elongated male piece. The male piece (10) generally comprises a proximal end (16), a distal end (18), a lower surface (14), and two lateral sides (11, 13), and in particular further includes a retaining member (50) in the proximal end (16) of the male piece (10). The retaining member (50) includes a proximal upper surface (12*a*) which extends upwardly higher than a distal upper surface (12*b*) of the male piece, and a flange (60) extends distally from the retaining member (50) and above the distal upper surface (12*b*) of the male piece (10), thereby forming a slot (52) between the flange (60) and the distal upper surface (12*b*) of the male piece. The male piece also includes a post (64) positioned distally of the retaining member (50) which extends upwardly from the distal upper surface (12*b*) of the male piece.

The elongated female piece (20) generally comprises a proximal end (26), a distal end (28), an upper surface (22), and a lower surface (24). The proximal end (26) includes a rotating member (30) having a curved outer surface (31) at a proximal end of the rotating member, at least one lateral side (33) at a distal end, and a central opening (25) for receiving the post (64) of the male piece. The distal end of the lateral side (33) connects to a proximally facing shoulder surface (29). The female piece 20 further includes a locking shoulder (42) on at least one lateral side of the rotating member (30), the locking shoulder (42) having a proximal lower end (41), a distal higher end (43), an upwardly facing sloped surface (46) between the lower end (41) and the higher end (43), and an upwardly facing support surface (44) extending distally from the higher end (43) of the locking shoulder (42).

The female piece (20) is rotatably connected to the male piece (10) by placing the central opening (25) of the rotating member (30) of the female piece (20) over the post (64) of the male piece (10), which is then retained within the opening (25). The female piece (20) can then be rotated around the post (64). When the female piece (20) is rotated around the post (64), the locking shoulder (42) of the female piece is thereby moved toward the retaining member (50) of the male piece (10). Upon continued rotation, the lower end (41) of the locking shoulder (42) enters the slot (52), and the sloped surface (46) of the locking shoulder (42) is brought into contact with the lower surface (62) of the flange (60), thereby resulting in a locked configuration of the clamp. Further rotation of the female piece brings an upwardly facing support surface (44) of the locking shoulder into contact with the lower surface (62) of the flange (60), and when a proximally facing shoulder surface (29) contacts a lateral side surface (61, 63) of the flange (60) the clamp is then in a fully open and locked configuration. The lateral surface at the distal end of rotating member (30) also preferably contacts the front surface (65) of the flange when the clamp is in the fully locked configuration.

The male piece and the female piece are both preferably rectangular and made from metal. The distal upper surface (12*b*) of the male piece and the lower surface (24) of the female piece are also preferably planar, and the distal upper surface (12*b*) of the male piece (10) and the lower surface (62) of the flange (60) are parallel. In preferred embodiments, the front surface (65) of the flange (60) is curved and contacts the curved outer surface (31) of the rotating member (30). The rotating member (30) can also have two lateral sides, each with locking shoulder (42), for greater flexibility of use of the present clamp.

The male piece can include at least one mounting hole (54) for retaining a fastener, such as a screw, which can be placed through the mounting hole in order to secure the clamp to a container (90) for a painting (70). Alternatively, the clamp can be attached to the back of a painting, i.e. to the framework holding the canvas of the painting (70). If the clamp is provided with a hanging loop (80), preferably in the proximal end (16) of the male piece, the painting can be hung (suspended) from wires attached to the hanging loop (80).

FIGURES

DESCRIPTION

Definitions

Figure 1:
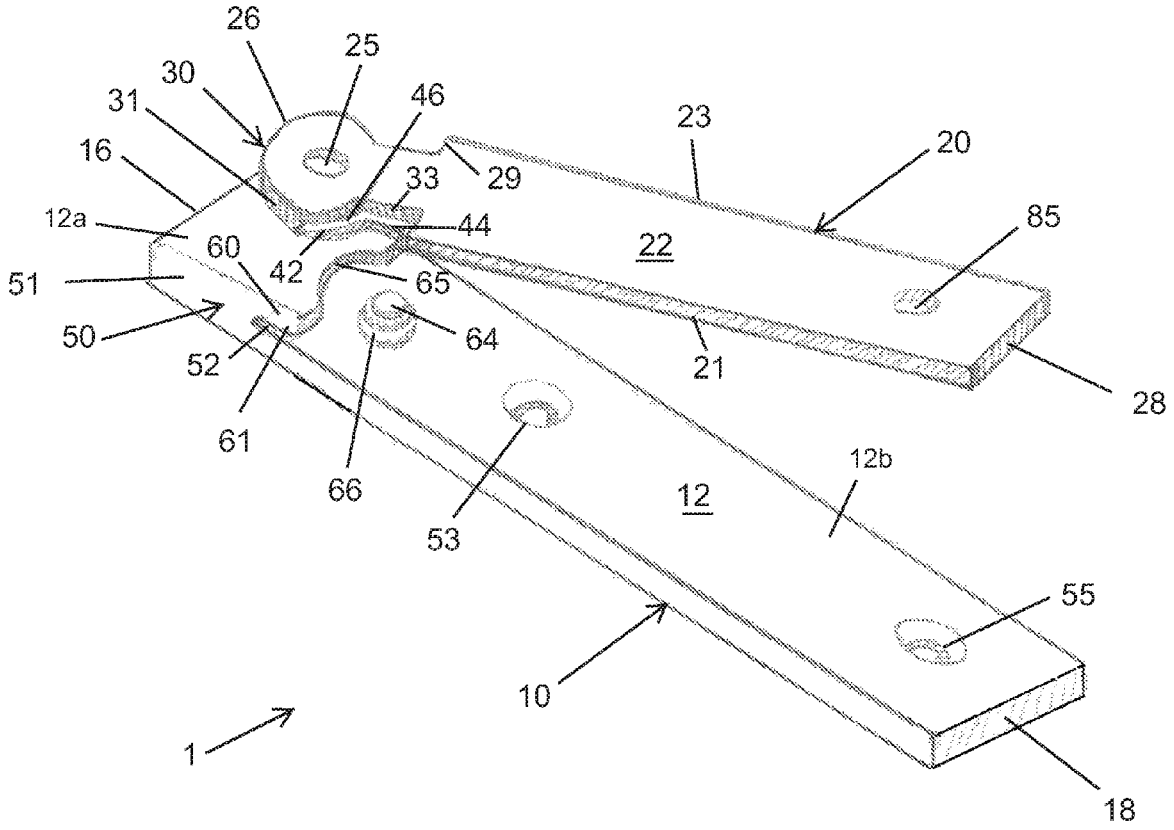
FIG. 1 is a perspective view of an embodiment of the present clamp in a partially open position.

As used herein, the following terms and variations thereof have the meanings given below, unless a different meaning is clearly intended by the context in which such term is used.

"Downwardly," "lower," and "below" refer to a direction which extends toward a support surface on which the present clamp is secured, and generally in the direction which extends from the upper surface toward and/or beyond the lower surface of the clamp.

"Elongated" refers to a configuration or shape having a length which is longer than its width.

"Fastener" refers to a mechanical component or device for attaching the present clamp to another object, such as a nail, screw, bolt, dowel, or other coupling.

"Flange" refers to a projecting flat rim or other projection on an object or on a component thereof.

"Hinge" refers to a joint that holds two parts together so that one part can articulate and move relative to the other.

"Horizontal" refers to an orientation approximately parallel to (i.e., not substantially extending toward or away from) a support surface on which the present apparatus is supported when in use.

"Post" refers to an upwardly extending projection for rotatably connecting the male piece and the female piece.

"Slope" refers to a surface of which one end or side is at a (vertically) higher level than another end or side.

"Slot" refers to a channel into which another member fits.

"Upwardly," "higher," and "above" refer to a direction which extends away from a support surface on which the present clamp is secured, and generally in the direction which extends from the lower surface toward and/or beyond the upper surface of the clamp.

"Vertical" refers to an orientation extending toward or away from a support surface on which the present apparatus is supported when in use.

Relative terms such as "above," "below," "right," "left," "upper," "lower," "proximal," "distal" and the like are used herein for convenience to describe the present invention or components thereof but are not to be construed as absolute terms. The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Clamp

The present invention comprises a substantially planar clamp 1 adapted to limit or prevent the movement of one object with respect to another, for example to retain a painting within a container such as a travel box. The present clamp 1 is formed from a rigid material, typically a metal such as bronze or steel, although other suitably rigid materials (such as a plastic material) can also be used, depending on the requirements for the strength of the clamp 1. The clamp 1 generally includes an elongated male piece 10 and an elongated female piece 20, both of which are preferably generally planar and rectangular in configuration, though other shapes are also possible. The male piece 10 has an upper side 12, lower side 14, proximal end 16, distal end 18, right lateral side 11, and left lateral side 13. At a proximal end 16 of the male piece 10, the male piece 10 comprises a retaining member 50 which includes a proximal upper surface 12*a*. The retaining member 50 extends upwardly (vertically) higher than a distal upper surface 12*b* located distally of the retaining member 50, such that the proximal upper surface 12*a* of the retaining member 50 is higher than the distal upper surface 12*b*. In the illustrated embodiments, the retaining member 50 comprises a vertically thicker portion of the male piece 10.

Figure 7:
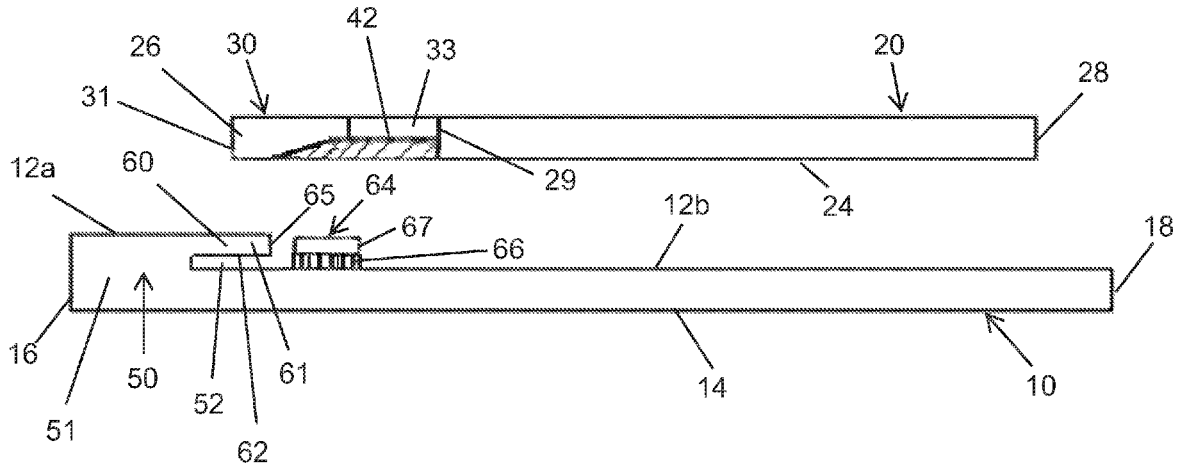
FIG. 7 is side elevation, exploded view of an embodiment of the present clamp.

Extending distally from the upper portion of the retaining member 50 is a generally horizontal flange 60 having a right lateral side 61, a left lateral side 63, a lower surface 62, and a front surface 65. The proximal portion of the flange 60 is secured to the upper end of the retaining portion 50, and in the illustrated embodiments is formed integrally with the retaining member 50. As best seen in FIG. 7, the lower surface 62 of the flange 60 is preferably planar and horizontal, and also preferably approximately parallel to the portion of the distal upper surface 12*b* below the lower surface 62. The space between the lower surface 62 of the flange 60 and the portion of the distal upper surface 12*b* below the lower surface 62 forms a slot 52 into which a locking shoulder 42 of the female piece 20 may be inserted. Preferably, the front surface 65 of the flange 60 is curved so as to accommodate the rotating member 30, whose outer surface 31 faces the front surface 65 of the flange 60 when the female piece 20 is mounted on the post 64, i.e. such that a center portion 69 of the front side 65 of the flange 60 extends distally from the retaining member 50 by a shorter distance (i.e., is located relatively more proximally) as compared to the lateral sides (61, 63) of the flange 60.

Located distally of the retaining member 50 is a vertically extending post 64 attached at its base (lower portion) to the upper surface 12 of the male piece 10. The post 64 has a cylindrical side surface 67 for retaining a circular opening 25 of a rotating member 30 in the female piece 20. Preferably, a retaining ring 66 can be fitted around the side surface 67 in order to help to retain the rotating member 30 on the post 64 and to maintain pressure between the male piece and the female piece, in order to avoid "play" (looseness) between the male and female pieces.

The female piece 20 has an upper side 22, lower side 24, proximal end 26, distal end 28, right lateral side 21, left lateral side 23, and a proximal opening 25. The proximal opening 25 preferably forms a through-hole through the proximal end 26 of the female piece 20, and forms a part of the rotating member 30 of the female piece 20. The proximal opening 25 has an inner surface 27 which faces the side surface 67 of the post 64 when the female piece 20 is mounted on the post 64. The side surface 67 of the post 64 and the inner surface 27 of the proximal opening 25 may be in direct contact, or in a preferred embodiment a retaining ring 66 is fitted between the side surface 67 of the post 64 and the inner surface 27 of the proximal opening 25.

The proximal end 26 of the female piece 20 comprises a rotating member 30 which is rotatable around the post 64, thereby forming a hinge and allowing the female piece 20 to be rotatable with respect to the male piece 10. The hinge in this case is preferably rotatable around an off-center axis, i.e. the post 64 is closer to the proximal end 16 of the elongated male piece 10 than to its center. The outer side surface 31 of the rotating member 30 preferably comprises a curved outer surface which extends along the proximal end 26 from one lateral surface 33 of the rotating member to a second side of the rotating member 30, i.e. between right lateral side 35 and left lateral side 37 of the rotating member. The lateral surfaces 33 preferably connect and/or are adjacent to a proximal shoulder 29 on each side of the proximal end of the female piece 20, though the present clamp will be operable without such a proximal shoulder 29 or with a shoulder 29 on only one side of the clamp 1. The proximal shoulder 29 comprises a lateral surface extending between a lateral side of the female piece 20 and a lateral surface 33 of the rotating member, i.e. between right lateral side 21 of the female piece 20 and right lateral side 35 of the rotating member 30, and/or between left lateral side 23 of the female piece 20 and left lateral side 37 of the rotating member 30.

Figure 8:
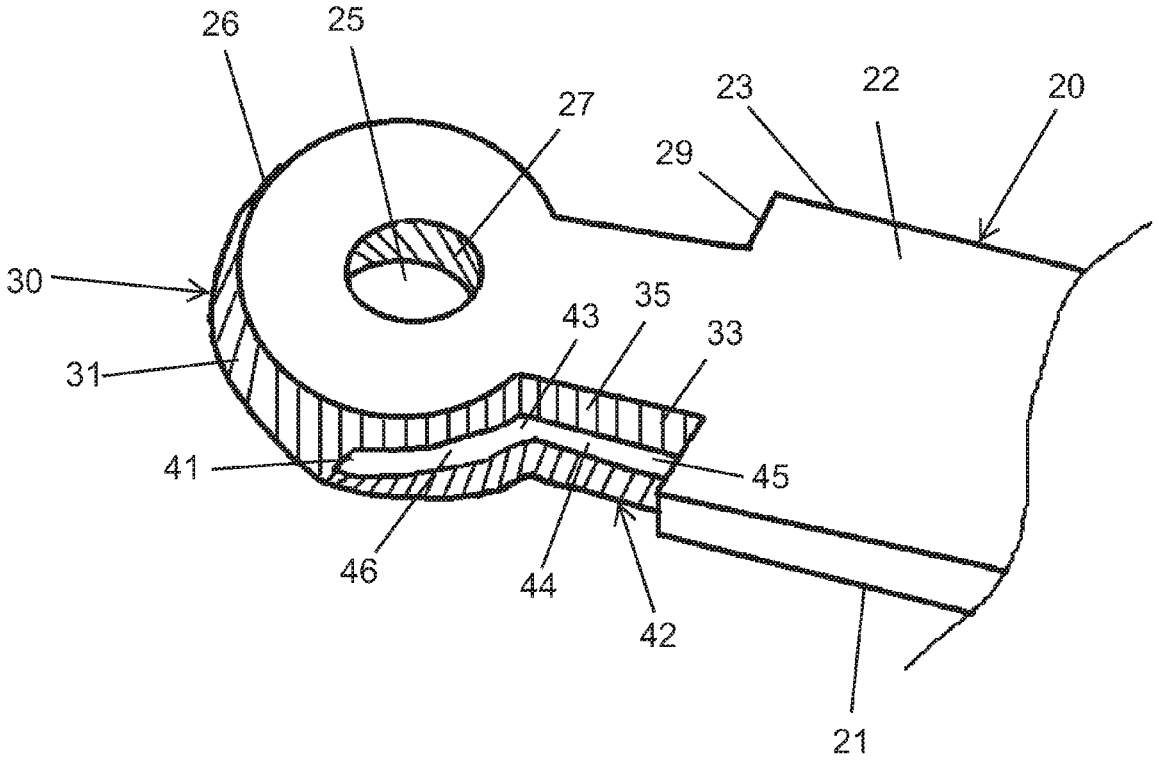
FIG. 8 is a perspective view of the proximal end of the female piece of the present clamp.

The right side 21 and/or left side 23 of the proximal end 26 of the female piece 20 includes a locking shoulder 42. As best seen in FIG. 8, the locking shoulder 42 comprises an upwardly facing sloped surface 46 extending at a non-right angle between the lower side 24 and upper side 22 of the female piece, i.e. between a proximal or lower end 41 of the locking shoulder 42 and a distally positioned higher end 43 of the locking shoulder. In the illustrated embodiments, an upwardly facing support surface 44 extends between the higher end 43 and a distal end 45 of the locking shoulder 42. The distal end 45 of the locking shoulder 42 is adjacent to and preferably adjoins (is connected to) the respective proximal shoulder 29 of the female piece 20. The support surface 44 is also preferably horizontal and generally planar, and is below the plane of the upper surface 22 of the female piece 20.

Figure 2:
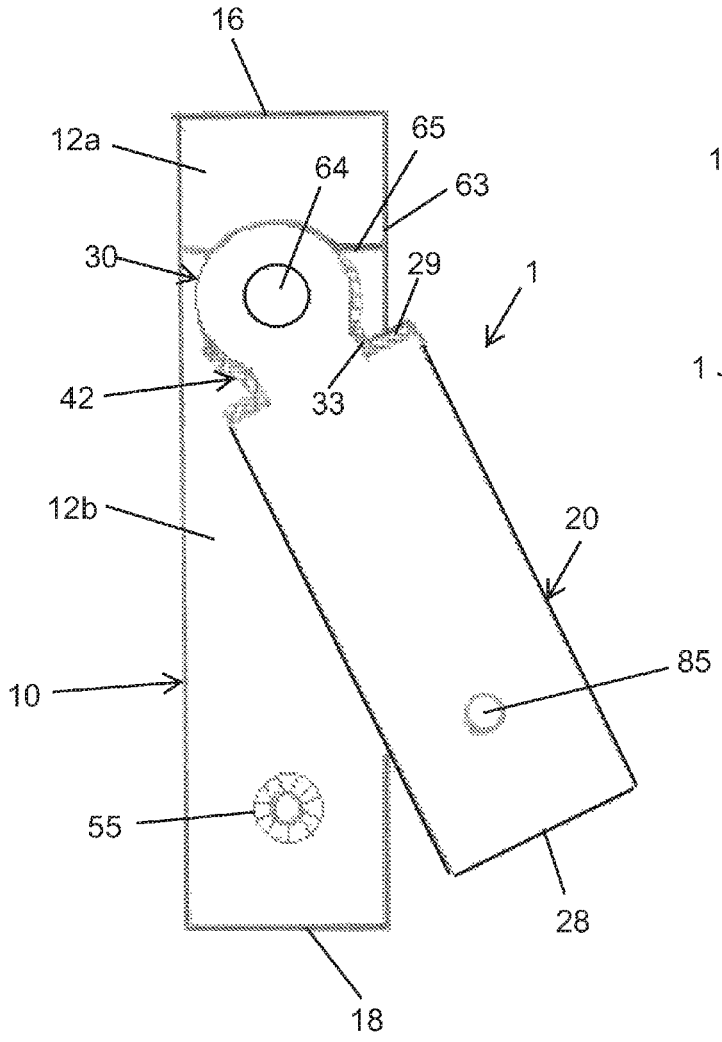
FIG. 2 is a top plan view of the clamp of FIG. 1 in a partially open position.
Figure 3:
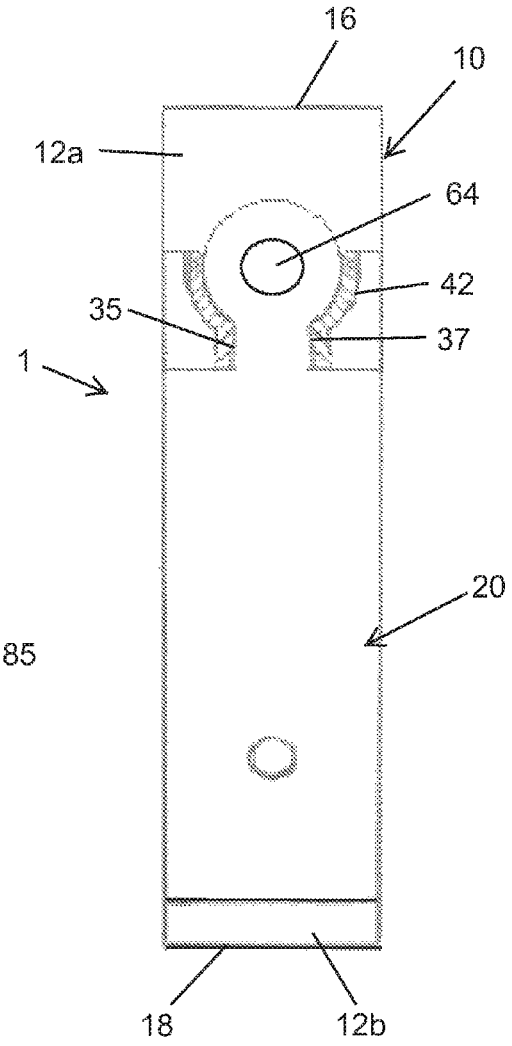
FIG. 3 is a top plan view of the clamp of FIG. 1 in a closed position.
Figure 4:
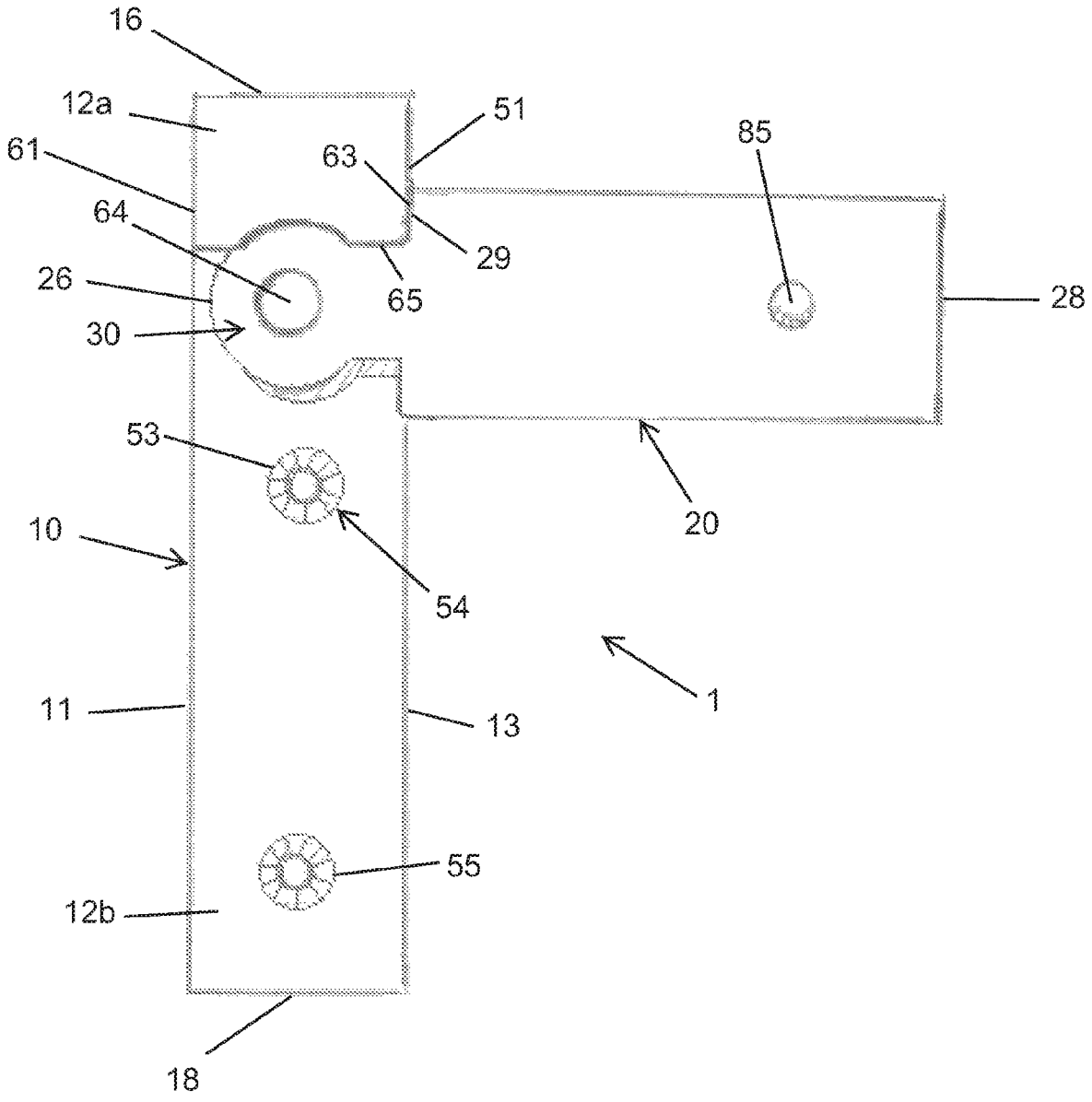
FIG. 4 is a top plan view of the clamp of FIG. 1 in an open position.
Figure 5:
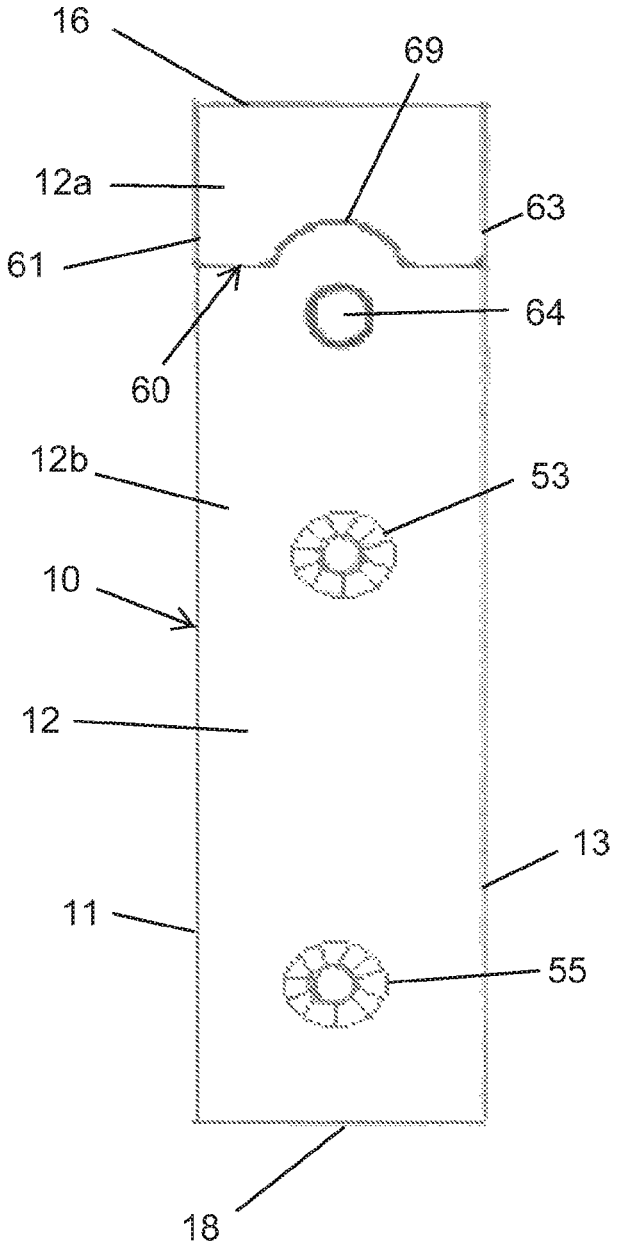
FIG. 5 is a top plan view of the male piece of the present clamp.
Figure 6:
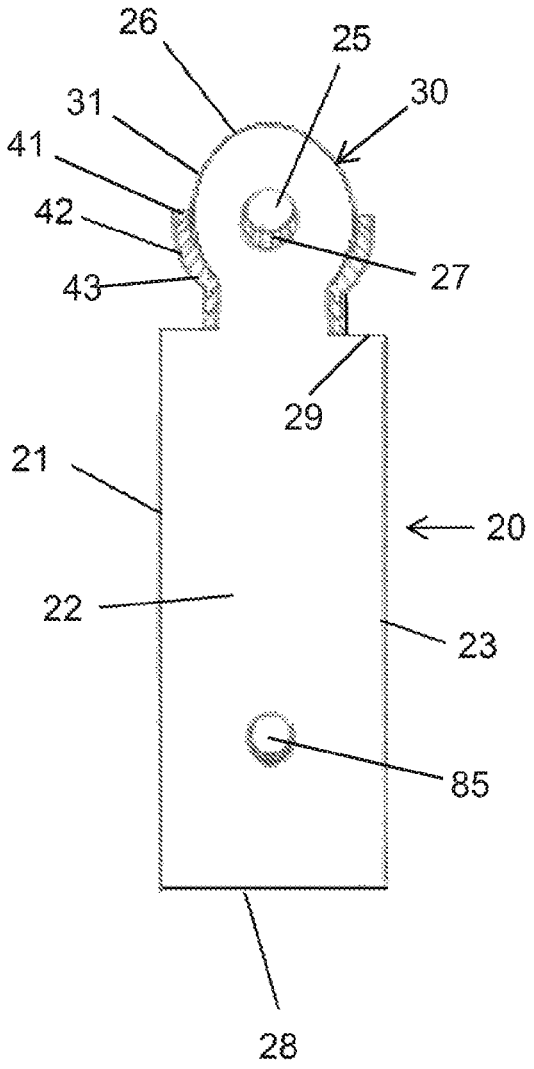
FIG. 6 is a top plan view of the female piece of the present clamp.

The present clamp 1 provides improved retention of a painting or other object because it can be more securely maintained in a locked position, i.e. a position in which the female piece 20 is rotated outwardly around the post 64 from the closed position shown in FIG. 3 to the open (locked) position shown in FIG. 4, such that the distal end 28 of the female piece is moved away from the distal end 18 of the male piece 10. The female piece 20 becomes locked with respect to the male piece 10 when the locking shoulder 42 is placed into the horizontal slot 52 between the distal upper surface 12*b* and the lower surface 62 of the flange 60 of the male piece 10, and when the sloped surface 46 comes into contact with the lower surface 62 of the flange 60. As the distal end 28 of the female piece 20 is moved further outwardly, for example from the closed position shown in FIG. 3 to a partially open position shown in FIG. 2, the locking shoulder 42 is further advanced into the slot 52, and the lower surface 62 of the flange 60 comes into contact with a higher portion of the upper surface 46 of the locking shoulder 42, which results in greater pressure being exerted between the lower surface 62 of the flange 60 and the upper surface 46 of the locking shoulder 42. As a result of such increased pressure, any looseness or "play" in the hinge formed by the retaining member 50 of the male piece 10 and the rotating member 30 of the female piece 20 is removed, and the female piece 20 becomes fixed in position with respect to the male piece 10 by an interference fit, i.e. by friction. The clamp 1 can be unlocked by rotating the female piece 20 in the opposite direction, i.e. inwardly such that the distal end 28 of the female piece is moved closer to the distal end 18 of the male piece.

In the illustrated embodiments, when the present clamp 1 is placed in a fully open and locked position, as shown in FIG. 4, the upper support surface 44 of the locking shoulder 42 is placed into contact with the lower surface 62 of the flange 60. The respective lateral surface 33 of the rotating member 30 will also contact the front surface 65 of the flange 60, and in addition the proximal shoulder 29 of the female piece 20 will contact a respective lateral side (61, 63) of the flange and/or a lateral side 51 of the retaining member 50. When the lateral surface 33 and proximal shoulder 29 contact respective surfaces on the male piece 10 in the fully locked configuration, further outward movement of the female piece 20 is prevented.

In one embodiment, the clamp 1 can be secured to a surface, such as a travel box or a painting frame. The male piece 10 preferably includes mounting holes 54, such as the upper mounting hole 53 and lower mounting hole 55 shown in the illustrated embodiments. Screws, bolts, or other fasteners can be placed through mounting holes 54 in the male piece 10 in order to secure the clamp 1 to another object.

Figure 9:
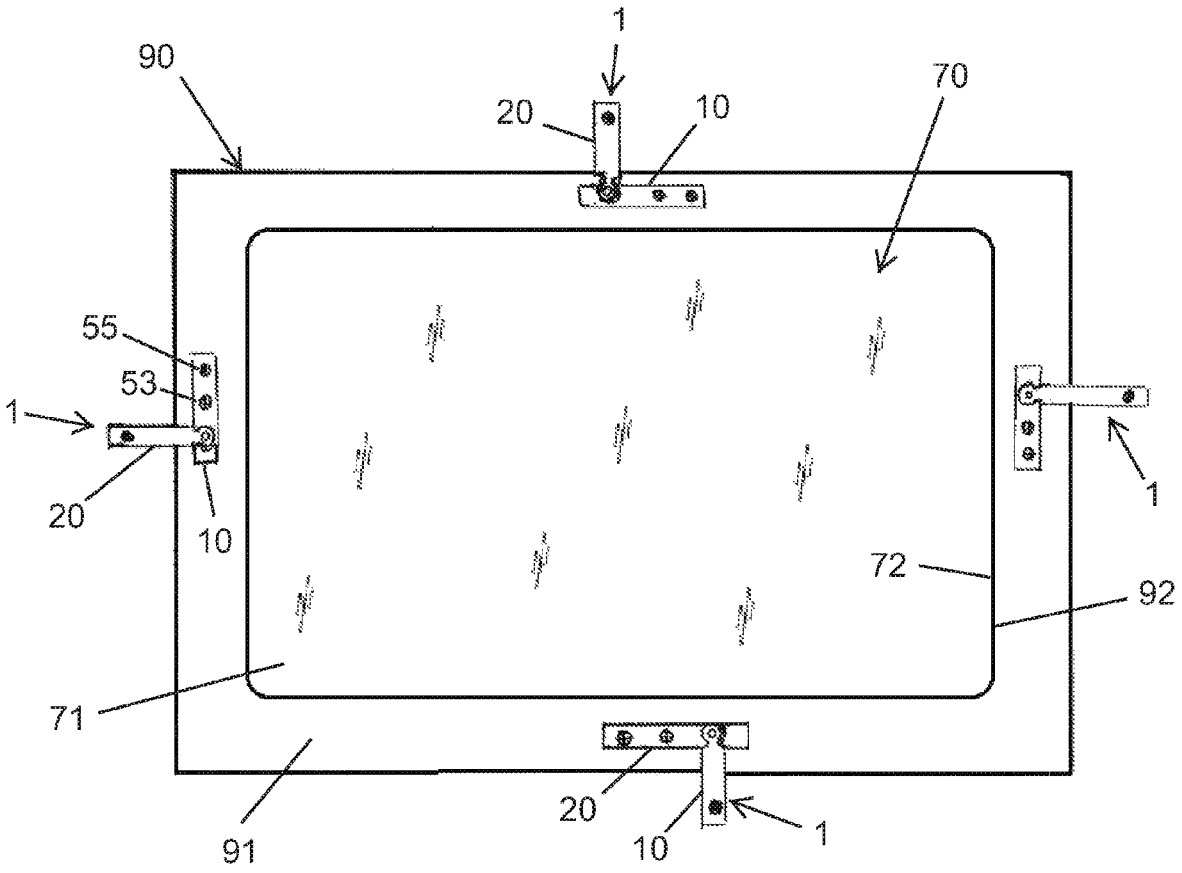
FIG. 9 is a side elevation view of the present clamp in use with a frame for a painting.

FIG. 9 illustrates the clamps 1 secured to the framework of a travel box 90 or other container for transporting a painting 70. The painting 70 is preferably positioned in the travel box 90 such that the outer edge 72 of the painting is adjacent the inner edge 92 of an upper surface 91 of the travel box 90, in order to minimize movement of the painting 70 within the travel box 90. In FIG. 9, the clamps 1 are secured to the upper surface 91 of the travel box 90 with fasteners placed in mounting holes 53 and 55. In FIG. 9, the female pieces 20 of the illustrated clamps 1 are rotated outwardly, i.e. away from the back surface 71 of the painting 70, so that the painting can be removed from the travel box. In order to secure the painting within the travel box, the female pieces 20 would be rotated inwardly until a lower side 24 of the distal end 28 of each female piece 20 is positioned on or adjacent to the back surface 71 of the painting. In this way, movement of the painting (or other object, in a different usage of the clamp 1) is prevented or restricted by contact between the painting back surface 71 and the lower side 24 of the female piece 20. Different lengths of female pieces 20 can be used to secure a painting or other object, depending on the object being secured and the placement of the clamps 1.

Figure 10:
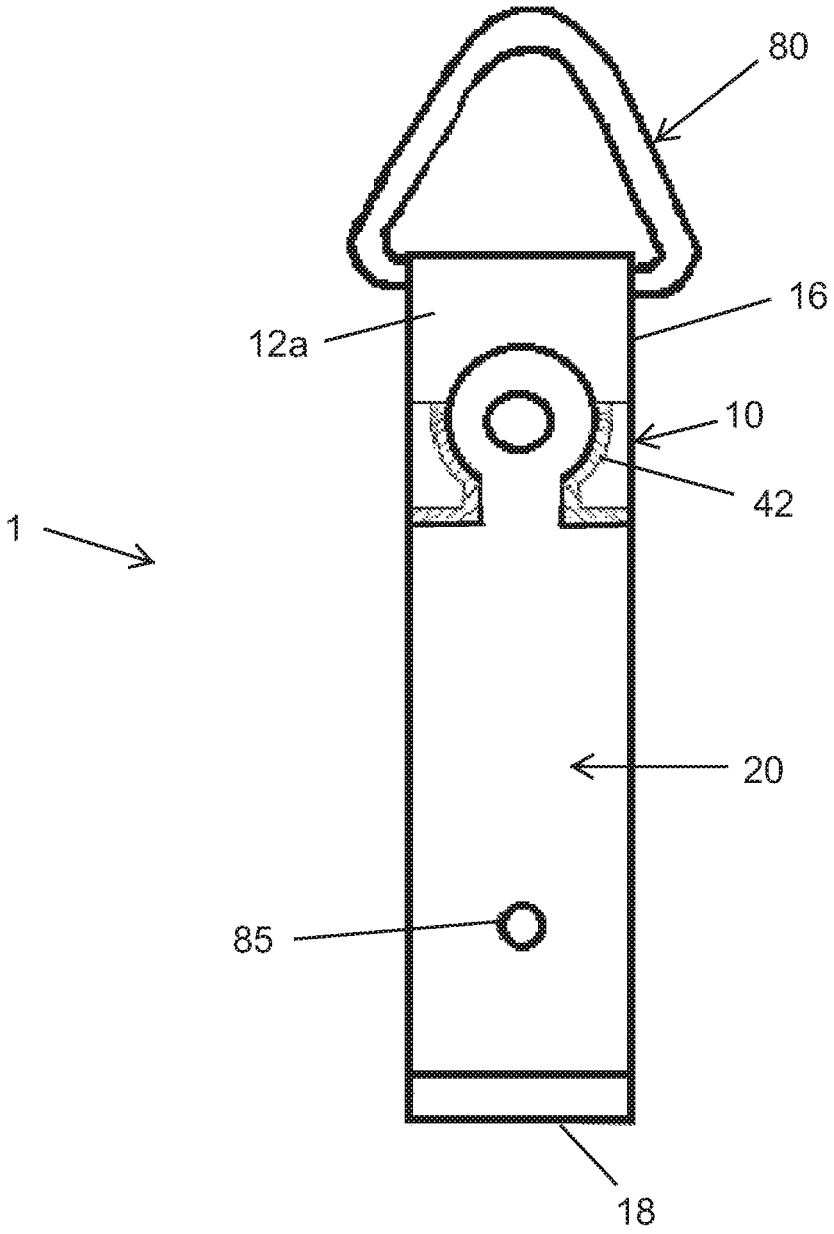
FIG. 10 is a top plan view of an alternative embodiment of the present clamp.

Alternatively, the present clamps 1 can be secured to the rear side of a painting, i.e. to the framework holding a canvas. In this case, the female piece 20 of the clamp 1 can be rotated outwardly until a lower side 24 of the distal end 28 of each female piece 20 is on or adjacent to the upper surface 91 of the travel box 90 to secure the painting to the travel box. When the present clamps 1 are secured to a painting 70, they can be optionally provided with a loop 80 for hanging the painting. A wire can be attached to the loop 80 in order to hang a painting. The hanging loop is preferably formed from a rigid material, such as brass or other metal, and is preferably attached at a proximal end 16 of the male piece, as shown in FIG. 10, although the loop 80 can also be attached to the distal end 18 of the male piece 10.

In addition, a mounting hole 85 can be included in a distal portion of the female piece 20. The mounting hole 85 can be used to mount a painting to a travel frame using retainers such as bolts, washers, and/or wingnuts.

The components shown in the figures are listed in Table 1 below:

TABLE 1

| Component | Reference Number |
|---|---|
| Clamp | 1 |
| Male piece | 10 |
| Male piece upper side | 12 |
| Male piece proximal upper surface | 12a |
| Male piece distal upper surface | 12b |
| Male piece lower side | 14 |
| Male piece proximal end | 16 |
| Male piece distal end | 18 |

TABLE 1-continued

| Component | Reference Number |
|---|---|
| Male piece right lateral side | 11 |
| Male piece left lateral side | 13 |
| Female piece | 20 |
| Female piece upper side | 22 |
| Female piece lower side | 24 |
| Female piece proximal end | 26 |
| Female piece distal end | 28 |
| Female piece right lateral side | 21 |
| Female piece left lateral side | 23 |
| Proximal (central) opening | 25 |
| Proximal opening inner surface | 27 |
| Proximal shoulder | 29 |
| Rotating member | 30 |
| Rotating member curved outer surface | 31 |
| Rotating member lateral surface | 33 |
| Rotating member right lateral side | 35 |
| Rotating member left lateral side | 37 |
| Locking shoulder | 42 |
| Shoulder proximal end (lower end) | 41 |
| Shoulder higher end | 43 |
| Shoulder distal end | 45 |
| Shoulder support surface | 44 |
| Shoulder sloped surface | 46 |
| Retaining member | 50 |
| Retaining member lateral side | 51 |
| Slot | 52 |
| Mounting holes | 54 |
| Upper mounting hole | 53 |
| Lower mounting hole | 55 |
| Flange | 60 |
| Flange right lateral side | 61 |
| Flange left lateral side | 63 |
| Flange front surface | 65 |
| Flange front surface center portion | 69 |
| Flange lower surface | 62 |
| Post | 64 |
| Post side surface | 67 |
| Retaining Ring | 66 |
| Painting | 70 |
| Painting rear surface | 71 |
| Painting outer edge | 72 |
| Hanging loop | 80 |
| Container | 90 |
| Container framework rear surface | 91 |
| Container framework inner edge | 92 |

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

Specific measurements are included herein as examples of specific embodiments of the present invention, and are not to be construed as being limiting. Recitation of value ranges herein is merely intended to serve as a shorthand method for referring individually to each separate value falling within the range. Unless otherwise indicated herein, each individual value is incorporated into the specification as if it were individually recited herein. All references cited herein are incorporated by reference in their entirety.

What is claimed is:

1. A clamp useful in securing paintings comprising:

(a) an elongated male piece having a proximal end, a distal end, a lower surface, and two lateral sides, wherein the male piece further comprises:

(i) a retaining member in the proximal end of the male piece and having a proximal upper surface which extends upwardly higher than a distal upper surface of the male piece;

(ii) a flange extending distally from the retaining member and above the distal upper surface of the male piece, thereby forming a slot between the flange and the distal upper surface of the male piece, wherein the flange comprises a lower surface, a right lateral side, a left lateral side, and a front surface; and (iii) a post positioned distally of the retaining member, the post extending upwardly from the distal upper surface of the male piece; and (b) an elongated female piece having a proximal end, a distal end, an upper surface, and a lower surface, wherein the proximal end of the female piece further comprises:

(i) a rotating member comprising a curved outer surface at a proximal end, at least one lateral surface at a distal end, and a central opening for receiving the post of the male piece, wherein the distal end of the lateral side connects to a proximally facing shoulder surface; and (ii) a locking shoulder on at least one lateral side of the rotating member, the locking shoulder having a proximal lower end, a distal higher end, a sloping surface between the lower end and the higher end, and an upwardly facing support surface extending distally from the higher end of the locking shoulder, wherein the post of the male piece is retained within the central opening of the rotating member in order to rotatably connect the female piece to the male piece, and wherein when the female piece is rotated around the post so as to bring the locking shoulder toward the retaining member, the lower end of the locking shoulder enters the slot, and further rotation of the female piece brings the sloping surface of the locking shoulder in contact with the lower surface of the flange, thereby resulting in a locked configuration of the clamp.

2. The clamp of claim 1, wherein the upwardly facing support surface of the locking shoulder contacts the lower surface of the flange when the clamp is in the locked configuration.

3. The clamp of claim 1, wherein the proximally facing shoulder surface contacts a lateral side surface of the flange when the clamp is in the locked configuration.

4. The clamp of claim 1, wherein the lateral surface at the distal end of rotating member contacts the front surface of the flange when the clamp is in the locked configuration.

5. The clamp of claim 1, wherein the front surface of the flange is curved and contacts the curved outer surface of the rotating member.

6. The clamp of claim 1, wherein the distal upper surface of the male piece and the lower surface of the female piece are planar.

7. The clamp of claim 1, wherein the rotating member has two lateral sides, and wherein each lateral side includes a locking shoulder.

8. The clamp of claim 1, wherein the distal upper surface of the male piece and the lower surface of the flange are parallel.

9. The clamp of claim 1, wherein the male piece includes at least one mounting hole for retaining a fastener.

10. The clamp of claim 1, further comprising a retaining ring around the post.

11. The clamp of claim 1, wherein the male piece and the female piece are both generally rectangular.

12. The clamp of claim 1, wherein the male piece and the female piece are both made from metal.

13. The clamp of claim 1, further comprising a hanging loop extending between the two lateral sides of the male piece.

14. The clamp of claim 13, wherein the hanging loop is attached to the proximal end of the male piece.

15. The clamp of claim 1, wherein the clamp is attached to a framework of a painting.

16. The clamp of claim 1, wherein the clamp is attached to a container for a painting.

* * * * *